US010762837B2

(12) United States Patent
Yang et al.

(10) Patent No.: US 10,762,837 B2
(45) Date of Patent: Sep. 1, 2020

(54) PIXEL CIRCUIT, A DRIVING METHOD THEREOF AND A DISPLAY APPARATUS

(71) Applicant: BOE TECHNOLOGY GROUP CO., LTD., Beijing (CN)

(72) Inventors: Shengji Yang, Beijing (CN); Xue Dong, Beijing (CN); Jing Lv, Beijing (CN); Xiaochuan Chen, Beijing (CN); Dongni Liu, Beijing (CN); Lei Wang, Beijing (CN); Li Xiao, Beijing (CN); Pengcheng Lu, Beijing (CN); Jie Fu, Beijing (CN); Han Yue, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 347 days.

(21) Appl. No.: 15/757,404

(22) PCT Filed: Aug. 16, 2017

(86) PCT No.: PCT/CN2017/097589

§ 371 (c)(1),
(2) Date: Mar. 5, 2018

(87) PCT Pub. No.: WO2018/133403

PCT Pub. Date: Jul. 26, 2018

(65) Prior Publication Data

US 2020/0234639 A1 Jul. 23, 2020

(30) Foreign Application Priority Data

Jan. 18, 2017 (CN) ..... 2017 1 0034618

(51) Int. Cl.
*G09G 3/3233* (2016.01)

(52) U.S. Cl.
CPC ..... *G09G 3/3233* (2013.01); *G09G 2320/02* (2013.01)

(58) Field of Classification Search
CPC ..... G09G 3/3233; G09G 2320/02
See application file for complete search history.

(56) References Cited

U.S. PATENT DOCUMENTS 8,902,208 B2 * 12/2014 Chung ..... G09G 3/3233 345/211
8,937,615 B2 * 1/2015 Kim ..... G09G 3/3233 345/211

(Continued)

FOREIGN PATENT DOCUMENTS

CN 103354079 A 10/2013
CN 104269142 A 1/2015

(Continued)

OTHER PUBLICATIONS

English translation of International Search Report and Written Opinion dated Nov. 13, 2017, for corresponding PCT Application No. PCT/CN2017/097589.

*Primary Examiner* — Vinh T Lam
(74) *Attorney, Agent, or Firm* — Kinney & Lange, P.A.

(57) ABSTRACT

Embodiments of the present disclosure provide a pixel circuit, a driving method thereof and a display apparatus. The pixel sub-circuit comprises a resetting sub-circuit is configured to control potentials of a first node and a second node according to inputting signals of a first signal terminal and a second signal terminal; a charging sub-circuit is configured to control a potential of the second node according to an inputting signal of a third signal terminal; a compensating sub-circuit configured to control the potentials of the first node and a third node according to inputting signals of a fourth and a fifth signal terminals and a potential of the second node; an outputting sub-circuit configured to control outputting signals of the first terminal of the light (Continued)

emitting device and a reading terminal according to the inputting signal of a sixth and a seventh signal terminals and a potential of the third node.

13 Claims, 12 Drawing Sheets

(56) References Cited

U.S. PATENT DOCUMENTS

| | | | | |
|---|---|---|---|---|
| 9,367,164 | B2 * | 6/2016 | Wu | G09G 3/3233 |
| 9,508,450 | B2 * | 11/2016 | Qing | G11C 19/184 |
| 9,535,531 | B2 * | 1/2017 | Tan | G06F 3/042 |
| 9,620,061 | B2 * | 4/2017 | Cao | G09G 3/3266 |
| 9,645,662 | B2 * | 5/2017 | Yang | G06F 3/0416 |
| 2013/0113768 | A1 | 5/2013 | Yamamoto et al. | |
| 2015/0002414 | A1 | 1/2015 | Tan et al. | |
| 2016/0210925 | A1 * | 7/2016 | Chung | G09G 3/3266 |
| 2016/0351121 | A1 * | 12/2016 | Kim | G09G 3/3233 |
| 2017/0032722 | A1 * | 2/2017 | Wang | G09G 3/006 |
| 2017/0032752 | A1 * | 2/2017 | Huang | G11C 19/28 |
| 2017/0061880 | A1 * | 3/2017 | Choi | G09G 3/3233 |
| 2017/0069264 | A1 * | 3/2017 | Dai | G09G 3/3233 |
| 2017/0103706 | A1 * | 4/2017 | Yang | G06K 9/0002 |
| 2017/0256200 | A1 | 9/2017 | Duan et al. | |

FOREIGN PATENT DOCUMENTS

| | | | |
|---|---|---|---|
| CN | 104851392 | A | 8/2015 |
| CN | 105933623 | A | 9/2016 |
| CN | 106782272 | A | 5/2017 |

* cited by examiner

PIXEL CIRCUIT, A DRIVING METHOD THEREOF AND A DISPLAY APPARATUS

CROSS-REFERENCE TO RELATED APPLICATION(S)

This application is a Section 371 National Stage Application of International Application No. PCT/CN2017/097589, which claims the benefit of Chinese Patent Application No. 201710034618.3, filed on Jan. 18, 2017, the entire contents of which are incorporated herein by reference.

TECHNICAL FIELD

Embodiment of the present disclosure relates to the field of display technology, and in particular, to a pixel circuit, a driving method thereof, and a display device.

BACKGROUND

A CMOS (Complementary Metal-Oxide Semiconductor) image sensor may receive an external light, convert the light into an electrical signal, and output the electrical signal. As being a detection circuit of a CMOS image sensor, an Active Pixel Sensor (APS) circuit has a non-uniform outputting current during a photoelectric conversion process of a photosensitive device, since the process of the source follower thin film transistors (TFT) may have a difference. Thus, the outputting current of the source follower TFT will be affected by its own threshold voltage, causing a display distortion.

SUMMARY

Embodiments of the present disclosure provide a pixel circuit, a driving method thereof and a display apparatus.

According to an aspect of the embodiments of the disclosure, there is provided a pixel circuit comprising a resetting sub-circuit, a charging sub-circuit, a compensating sub-circuit and an outputting sub-circuit, wherein:

the resetting sub-circuit is connected to a first signal terminal, a first voltage terminal, a second signal terminal, a first node and a second node respectively, and configured to control potentials of the first node and the second node according to inputting signals of the first signal terminal and the second signal terminal;

the charging sub-circuit is connected to a third signal terminal and the second node, and configured to control a potential of the second node according to an inputting signal of the third signal terminal;

the compensating sub-circuit is connected to the second node, the first node, the first voltage terminal, a fourth signal terminal, a third node, the second voltage terminal and a fifth signal terminal, and configured to control the potentials of the first node and the third node according to inputting signals of the fourth signal terminal and the fifth signal terminal and the potential of the second node; and the outputting sub-circuit is connected to a first terminal of a light emitting device which has its second terminal connected to a ground, wherein the outputting sub-circuit is connected to the third node, a sixth signal terminal, a reading terminal and a seventh signal terminal, and configured to control a signal outputted to the first terminal of the light emitting device and an outputting signal of the reading terminal according to the inputting signal of the sixth signal terminal and the seventh signal terminal and the potential of the third node.

For example, the outputting sub-circuit comprises:

a reading circuit, connected to the third node, the reading terminal and the sixth signal terminal, and configured to control the outputting signal of the reading terminal according to the input signal of the sixth signal terminal and the potential of the third node; and a light emitting circuit, connected to the third node, the seventh signal terminal and a first terminal of the light emitting device, and configured to control a signal outputted to the first terminal of the light emitting device according to the input signal of the seventh signal terminal and the potential of the third node.

For example, the resetting sub-circuit comprises a first transistor and a second transistor;

the first transistor has a gate connected to the first signal terminal, a first electrode connected to the first voltage terminal and a second electrode connected to the second node; and the second transistor has a gate connected to the second signal terminal, a first electrode connected to the ground and a second electrode connected to the first node.

For example, the charging sub-circuit comprises a third transistor and a first capacitor, wherein:

the third transistor has a first electrode connected to a second electrode of a photosensitive device whose first electrode is connected to a ground, a gate connected to the third signal terminal, and a second electrode connected to the second node; and the first capacitor has a first terminal connected to the ground and a second terminal connected to the second node.

For example, the compensating sub-circuit comprises a fourth transistor, a fifth transistor, a sixth transistor and a second capacitor, wherein:

the fourth transistor has a gate connected to the fifth signal terminal, a first electrode connected to the second node and a second electrode connected to the second voltage terminal;

the fifth transistor has a gate connected to the first node, a first electrode connected to the second node and a second electrode connected to the third node;

the sixth transistor has a gate connected to the fourth signal terminal, a first electrode connected to the first node and a second electrode connected to the third node; and the second capacitor has a first terminal connected to the first node and a second terminal connected to the first voltage terminal.

For example, the reading circuit comprises a seventh transistor, wherein the seventh transistor has a gate connected to the sixth signal terminal, a first electrode connected to the third node and a second electrode connected to the reading terminal.

For example, the reading circuit comprises an eighth transistor, wherein the eighth transistor has a gate connected to the seventh signal terminal, a first electrode connected to the third node and a second electrode connected to the first terminal of the light emitting device.

For example, the transistors are an N-type transistor or a P-type transistor.

For example, the photosensitive device comprises a photodiode.

According to another aspect of the embodiments of the present disclosure, there is provided a display apparatus comprising the pixel circuit according to the embodiments of the present disclosure.

According to another aspect of the embodiments of the present disclosure, there is provided a method of driving a pixel circuit, comprising the pixel circuit according to the embodiments of the present disclosure, wherein the first voltage terminal is applied to a voltage at a first level, and the second voltage terminal is applied to a data signal voltage;

the method of driving the pixel circuit comprises:

applying, a second level to the first signal terminal, the second level to the second signal terminal, the second level to the third signal terminal, the first level to the fourth signal terminal, the first level to the fifth signal terminal, the first level to the sixth signal terminal and the first level to the seventh signal terminal, during a first period;

applying, the first level to the first signal terminal, the first level to the second signal terminal, the second level to the third signal terminal, the first level to the fourth signal terminal, the first level to the fifth signal terminal, the first level to the sixth signal terminal and the first level to the seventh signal terminal, during a second period;

applying, the first level to the first signal terminal, the first level to the second signal terminal, the first level to the third signal terminal, the second level to the fourth signal terminal, the first level to the fifth signal terminal, the first level to the sixth signal terminal and the first level to the seventh signal terminal, during a third period; and applying, the second level to the first signal terminal, the first level to the second signal terminal, the first level to the third signal terminal, the first level to the fourth signal terminal, the first level to the fifth signal terminal, the second level to the sixth signal terminal and the first level to the seventh signal terminal, during a fourth period.

For example, the method further comprises:

applying, a first level to the first signal terminal, the second level to the second signal terminal, the first level to the third signal terminal, the first level to the fourth signal terminal, the first level to the fifth signal terminal, the first level to the sixth signal terminal and the first level to the seventh signal terminal, during a fifth period;

applying, the first level to the first signal terminal, the first level to the second signal terminal, the first level to the third signal terminal, the second level to the fourth signal terminal, the second level to the fifth signal terminal, the first level to the sixth signal terminal and the first level to the seventh signal terminal, during a sixth period; and applying, the second level to the first signal terminal, the first level to the second signal terminal, the first level to the third signal terminal, the first level to the fourth signal terminal, the first level to the fifth signal terminal, a high level to the sixth signal terminal and the second level to the seventh signal terminal, during a seventh period.

DETAILED DESCRIPTION

In order to make a better understanding of technical solutions in embodiments of the present disclosure for those skilled in the art, a pixel circuit, a driving method thereof and a display apparatus according to the embodiments of the present disclosure are described in detail below with reference to the accompanying drawings.

Figure 1:
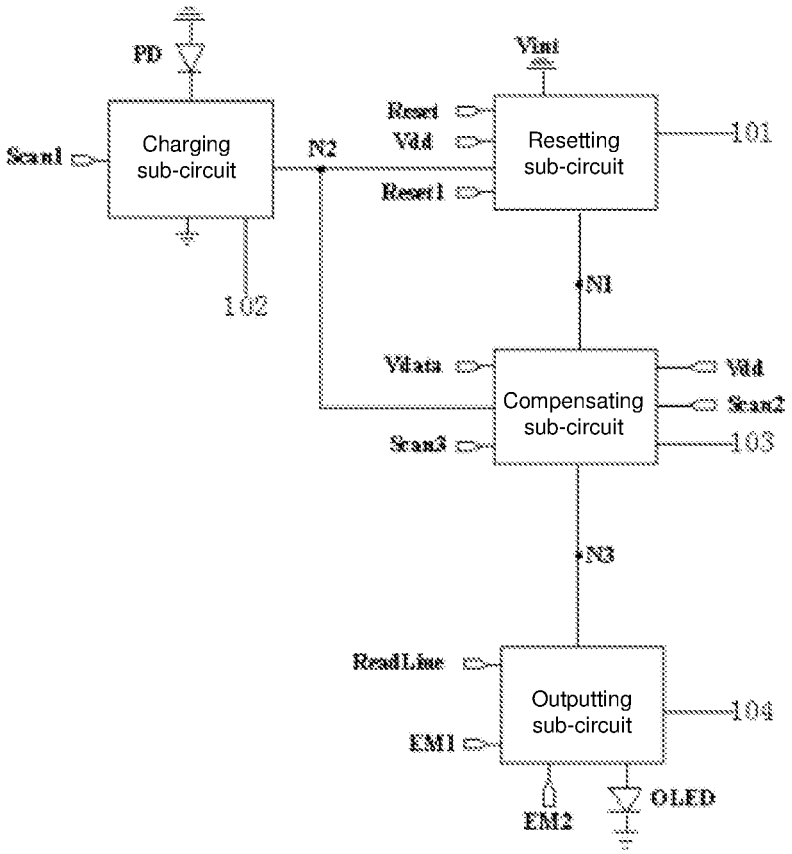
FIG. 1 shows a schematic structural diagram illustrating a pixel circuit according to an embodiment of the present disclosure.

FIG. 1 shows a schematic structural diagram illustrating a pixel circuit according to an embodiment of the present disclosure. As shown in FIG. 1, the pixel circuit may comprise a resetting sub-circuit 101, a charging sub-circuit 102, a compensating sub-circuit 103 and an outputting sub-circuit 104.

In one embodiment, the pixel circuit is connected to a light emitting device OLED which has its first terminal connected to the outputting sub-circuit 104 and its second terminal connected to a ground.

In one embodiment, the pixel circuit is connected to a photosensitive device PD which has its first terminal connected to the ground and its second terminal connected to the charging sub-circuit 102.

In one embodiment, the photosensitive device PD comprises a photodiode, and the light emitting device OLED is an organic electroluminescent device.

Referring to FIG. 1, in the pixel sub-circuit according to the embodiment of the disclosure, the resetting sub-circuit 101 is connected to a first signal terminal Reset, a first voltage terminal Vdd, a second signal terminal Reset1, a first node N1 and a second node N2, and configured to control potentials of the first node N1 and the second node N2 according to inputting signals of the first signal terminal Reset and the second signal terminal Reset1. The charging sub-circuit 102 is connected to the third signal terminal Scan1 and the second node N2, and configured to control a potential of the second node N2 according to an inputting signal of the third signal terminal Scan1. The compensating sub-circuit 103 may be connected to the second node N2, the first node N1, the first voltage terminal Vdd, a fourth signal terminal Scan2, the third node N3, a second voltage terminal Vdata and a fifth signal terminal Scan3, and configured to control the potentials of the first node N1 and the third node N3 according to inputting signals of the fourth signal terminal Scan2 and the fifth signal terminal Scan3 and the potential of the second node N2. The outputting sub-circuit 104 may be connected to the third node N3, the sixth signal terminal EM1, a reading terminal ReadLine and a seventh signal terminal EM2, and configured to control a signal outputted to the first terminal of the light emitting device OLED and an outputting terminal of the reading terminal ReadLine according to the inputting signal of the sixth signal terminal EM1 and the seventh signal terminal EM2 and the potential of the third node N3.

Figure 2:
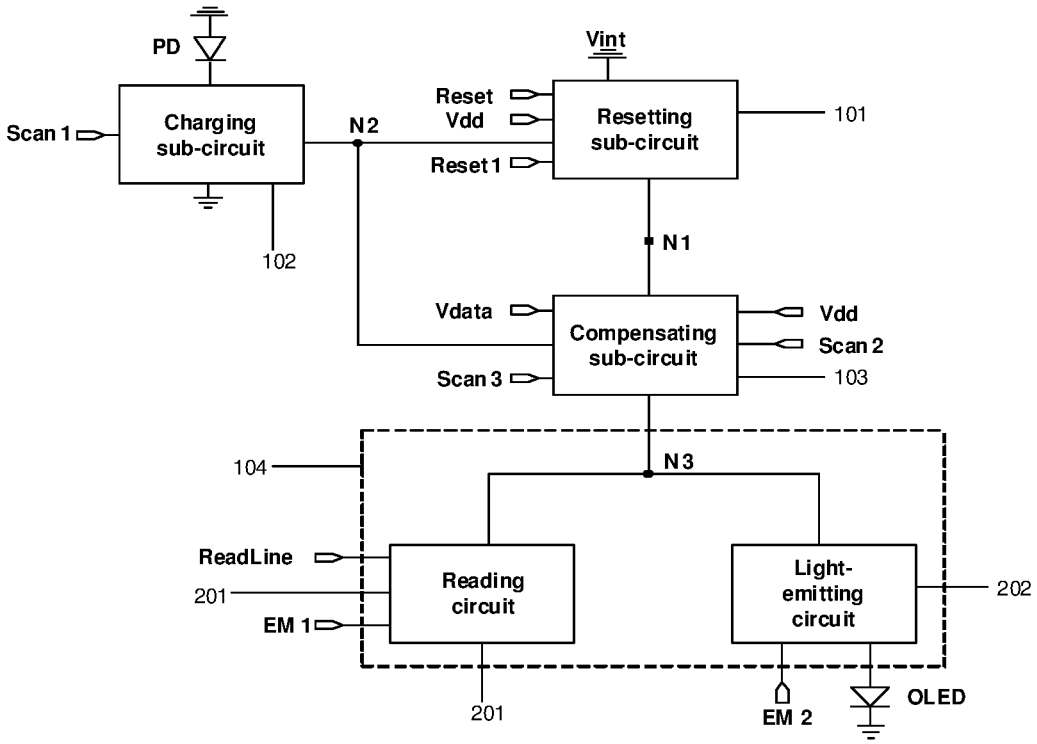
FIG. 2 shows a schematic structural diagram illustrating another pixel circuit according to an embodiment of the present disclosure.

FIG. 2 shows a schematic structural diagram illustrating another pixel circuit according to an embodiment of the present disclosure. As shown in FIG. 2, the outputting sub-circuit 104 comprises a reading circuit 201 and a light emitting circuit 202. The reading circuit 201 is connected to the third node N3, the reading terminal ReadLine and the sixth signal terminal EM1, and configured to control the outputting signal of the reading terminal ReadLine according to the input signal of the sixth signal terminal EM1 and the potential of the third node N3. The light emitting circuit 202 is connected to the third node N3, the seventh signal terminal EM2 and a first terminal of the light emitting device OLED, and configured to control a signal outputted from the first terminal of the light emitting device OLED according to the input signal of the seventh signal terminal EM2 and the potential of the third node N3.

Figure 3:
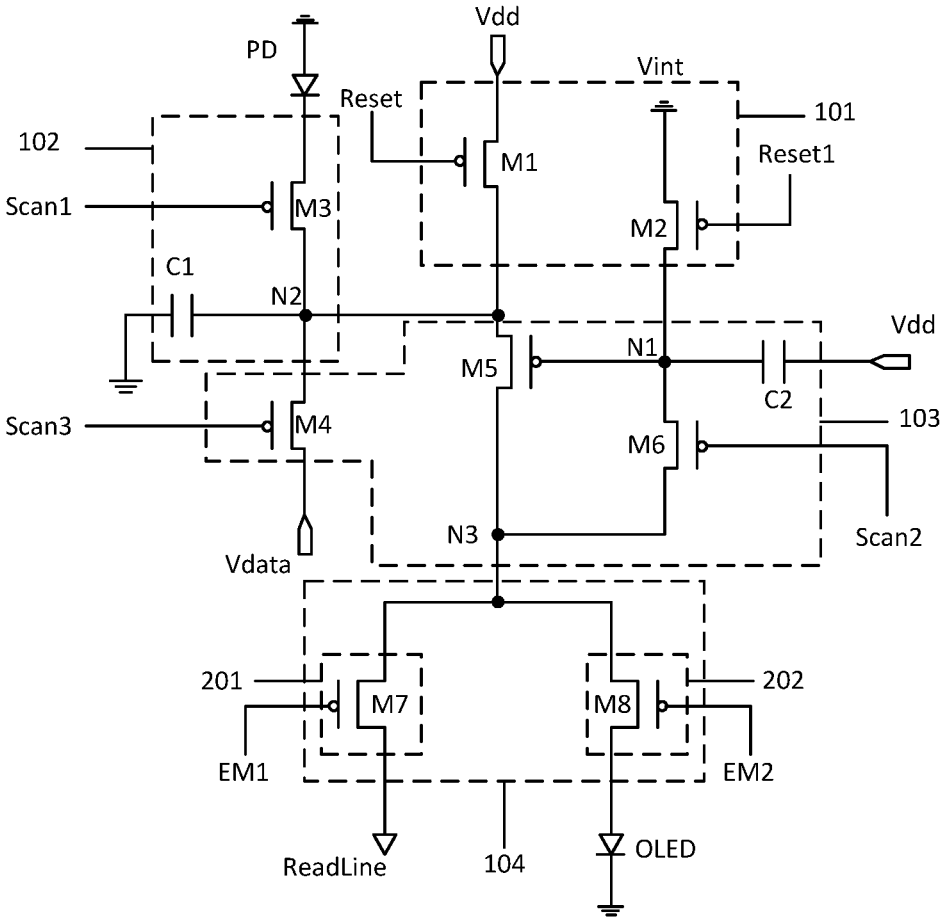
FIG. 3 shows detailed structural diagram illustrating the pixel circuit shown in FIG. 2.

FIG. 3 shows detailed structural diagram illustrating the pixel circuit shown in FIG. 2. As shown in FIG. 3, the resetting sub-circuit 101 comprises a first transistor M1 and a second transistor M2. The first transistor M1 has a gate connected to the first signal terminal Reset, a first electrode connected to the first voltage terminal Vdd and a second electrode connected to the second node N2. The second transistor M2 has a gate connected to the second signal terminal Reset1, a first electrode connected to the ground and a second electrode connected to the first node N1.

Referring to FIG. 3, the charging sub-circuit 102 comprises a third transistor M3 and a first capacitor C1. The third transistor M3 has a gate connected to the third signal terminal, a first electrode connected to a second electrode of a photosensitive device PD and a second electrode connected to the second node N2. The first capacitor C1 has a first terminal connected to the ground and a second terminal connected to the second node N2.

Referring to FIG. 3, the compensating sub-circuit 103 comprises a fourth transistor M4, a fifth transistor M5, a sixth transistor M6 and a second capacitor C2. The fourth transistor M4 has a gate connected to the fifth signal terminal Scan3, a first electrode connected to the second node N2 and a second electrode connected to the second voltage terminal Vdata. The fifth transistor M5 has a gate connected to the first node N1, a first electrode connected to the second node N2 and a second electrode connected to the third node N3. The sixth transistor M6 has a gate connected to the fourth signal terminal Scan2, a first electrode connected to the first node N1 and a second electrode connected to the third node N3. The second capacitor C2 has a first terminal connected to the first node N1 and a second terminal connected to the first voltage terminal Vdd.

Referring to FIG. 3, the reading circuit comprises a seventh transistor M7. The seventh transistor M7 has a gate connected to the sixth signal terminal EM1, a first electrode connected to the third node N3 and a second electrode connected to the reading terminal ReadLine. The light emitting circuit comprises an eighth transistor M8. The eighth transistor M8 has a gate connected to the seventh signal terminal EM2, a first electrode connected to the third node N3 and a second electrode connected to the first terminal of the light emitting device OLED.

According to the embodiment of the present disclosure, the first transistor M1, the second transistor M2, the third transistor M3, the fourth transistor M4, the sixth transistor M6, the seventh transistor M7 and the eighth transistor M8 are switching transistors (switching TFT). The fifth transistor M5 is a source follower driving transistor (driving TFT). The switching transistor, the driving transistor and the source follower driving transistor used in the embodiments of the present disclosure may be thin film transistors, such as oxide semiconductor transistors. Since the source and the drain of the thin film transistor used herein are symmetrical, the source and the drain of the thin film transistor can be exchanged. In an embodiment of the present disclosure, one of the source and the drain is referred to as the first electrode, and the other is referred to as the second electrode. For the convenience of description, all of the thin film transistors in the following examples are P-type thin film transistors whose gate-on voltage is at a low level. It should be understood for those skilled in the art that the thin film transistor may also be an N-type thin film transistor, and in this case, the polarity of the gate controlling signal should be changed accordingly.

By sharing the driving signal and the scanning signal, the pixel circuit according to the embodiments of the present disclosure can not only realize the high-resolution silicon-based display function but also have the environment image monitoring function. In addition, the solution according to the embodiment compensates for the source follower transistor of the pixel circuit to avoid a non-uniform outputting current caused by the difference of the source follower transistors itself, so that the outputting current is independent from the threshold voltage of the source follower transistor.

According to another aspect of embodiments of the present disclosure, there is provided a display apparatus including the pixel circuit according to the embodiment of the present disclosure.

In the display apparatus according to the embodiment of the present disclosure, the pixel circuit may include a resetting sub-circuit, a charging sub-circuit, a compensating sub-circuit, an outputting sub-circuit and a light emitting device. The resetting sub-circuit is configured to control potentials of the first node and the second node according to inputting signals of the first signal terminal and the second signal terminal. The charging sub-circuit is configured to control a potential of the second node according to an inputting signal of the third signal terminal. The compensating sub-circuit is configured to control the potentials of the first node and the third node according to inputting signals of the fourth signal terminal and the fifth signal terminal and the potential of the second node. The outputting sub-circuit is configured to control a signal outputted to the first terminal of the light emitting device and an outputting signal of the reading terminal according to the inputting signal of the sixth signal terminal and the seventh signal terminal and the potential of the third node.

Figure 4:
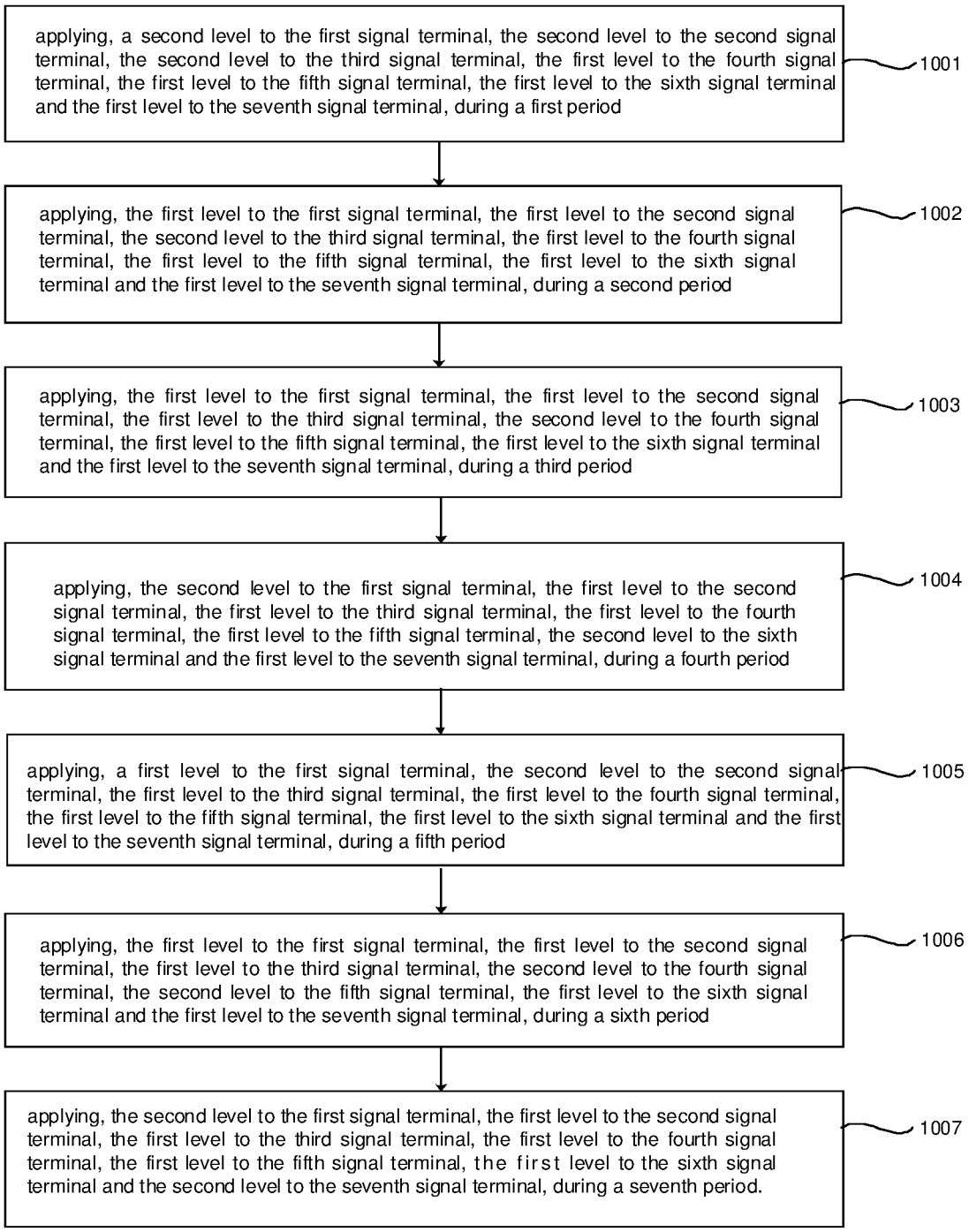
FIG. 4 shows a flowchart illustrating a driving method for a pixel circuit according to an embodiment of the present disclosure.
Figure 5:
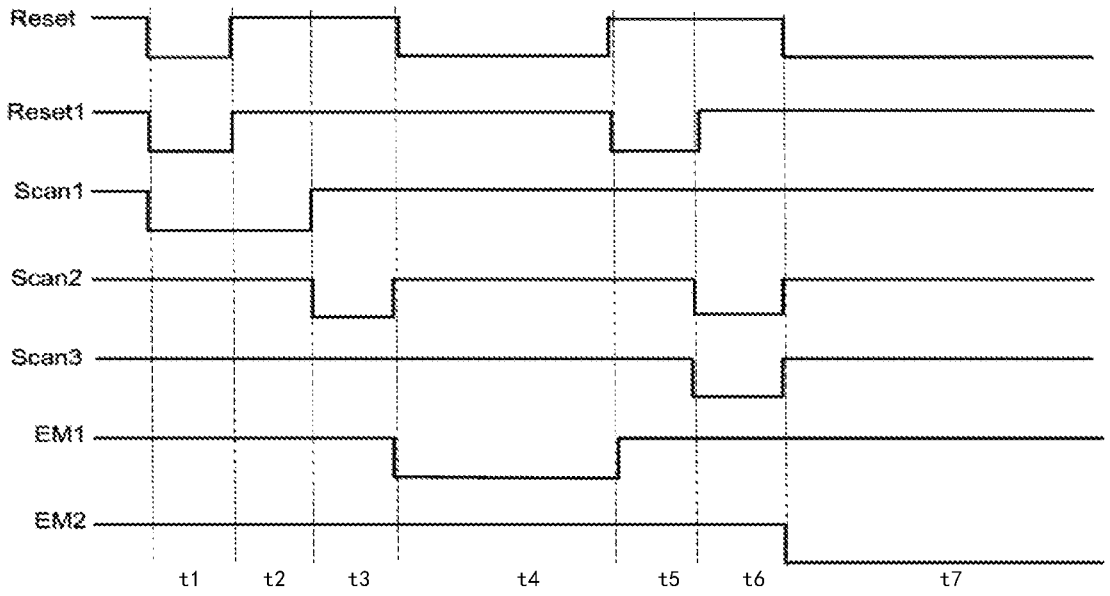
FIG. 5 shows an operation timing diagram of the pixel circuit according to an embodiment of the present disclosure.

FIG. 4 shows a flowchart illustrating a driving method for a pixel circuit according to an embodiment of the present disclosure. FIG. 5 shows an operation timing diagram of the pixel circuit according to an embodiment of the present disclosure. In an example of FIGS. 4 and 5, the first voltage terminal Vdd is applied to a high level, and the second voltage terminal Vdata is applied to a data signal voltage.

In the following example, all of the transistors M1 to M8 are P-type transistors with a gate-on voltage of a low level. It should be understood by those skilled in the art that the transistors may also be an N-type transistors, in which case the gate-on voltage is at a high level.

The driving method of the pixel circuit may include following steps.

At step 1001, during the first period t1, the input signal of the first signal terminal is at a low level, the input signal of the second signal terminal is at a low level, the input signal of the third signal terminal is at a low level, the input signal of the fourth signal terminal is at a high level, the input signal of the fifth signal terminal is at a high level, the input signal of the sixth signal terminal is at a high level and the input signal of the seventh signal terminal is at a high level.

Figure 6:
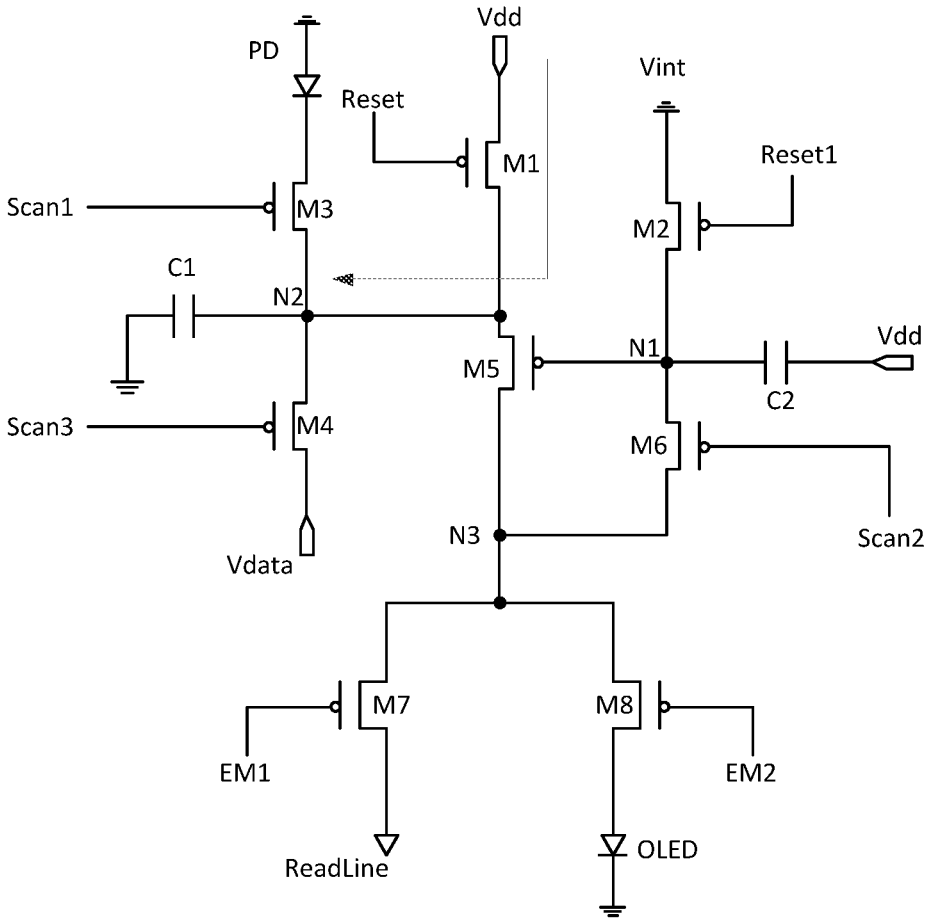
FIG. 6 shows a schematic diagram of the current flow of the pixel circuit during the first period according to the driving method of FIG. 4.

FIG. 6 shows a schematic diagram of the current flow of the pixel circuit during the first period t1 according to the embodiment of FIG. 4. As shown in FIG. 6, the direction of the arrow in the figure represents the current flow. During the first period t1, the inputting signal of the first signal terminal Reset is at a low level, the inputting signal of the second signal terminal Reset1 is at a low level, the inputting signal of the third signal terminal Scan1 is at a low level, the inputting signal of the fourth signal terminal Scan2 is at a high level, the inputting signal of the fifth signal terminal Scan3 is at a high level, the inputting signal of the sixth signal terminal EM1 is at a high level and the inputting signal of the seventh signal terminal EM2 is at a high level. At this time, the first transistor M1, the second transistor M2 and the third transistor M3 are turned on, and the other transistors are turned off. In this case, the potential of the first node N1 is reset to Vint, for example, 0V. Certainly, the potential of the first node N1 could also be reset to a negative voltage, so that the fifth transistor M5 is turned on and the potential of the second node N2 is Vdd. Meanwhile, the voltage signals will be reset.

At step 1002, during the second period t2, the inputting signal of the first signal terminal is at a high level, the inputting signal of the second signal terminal is at a high level, the inputting signal of the third signal terminal is at a low level, the inputting signal of the fourth signal terminal is at a high level, the inputting signal of the fifth signal terminal is at a high level, the inputting signal of the sixth signal terminal is at a high level, and the inputting signal of the seventh signal terminal is at a high level.

Figure 7:
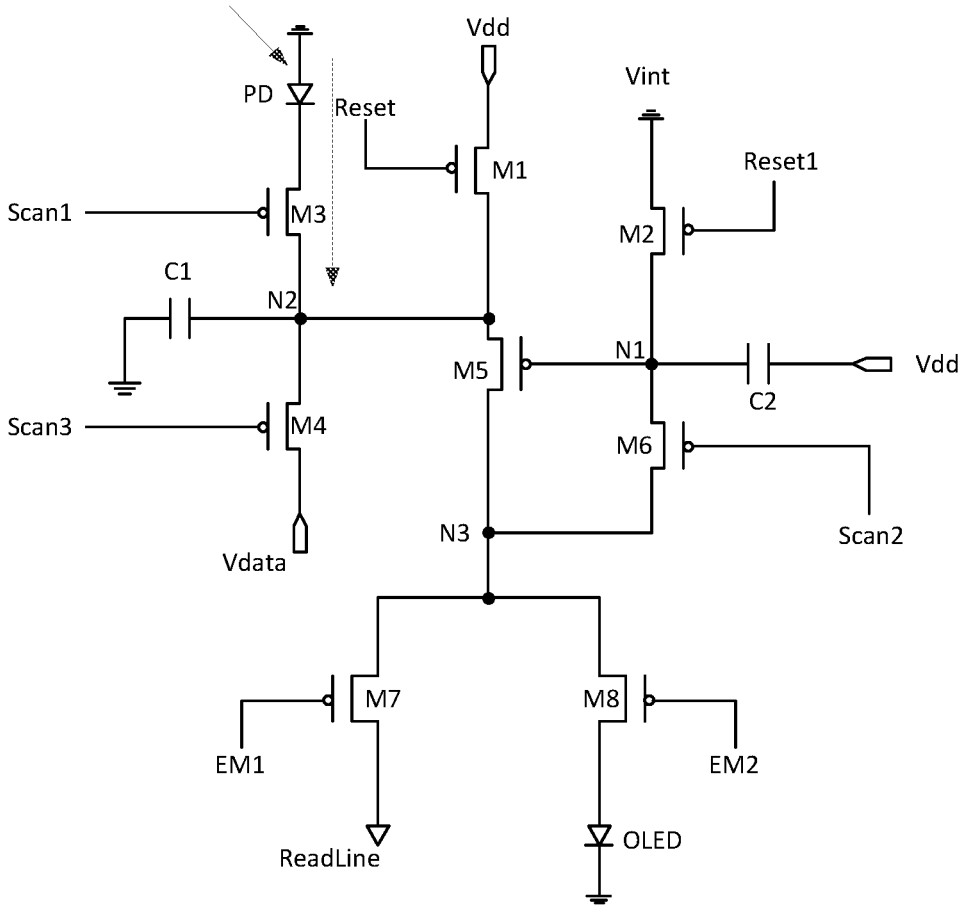
FIG. 7 shows a schematic diagram of the current flow of the pixel circuit during the second period according to the driving method of FIG. 4.

FIG. 7 shows a schematic diagram of the current flow of the pixel circuit during the second period t2 according to the embodiment of FIG. 4. As shown in FIG. 6, an arrow on the photosensitive device PD indicates for a photoelectrical reaction. During the second period t2, the inputting signal of the first signal terminal Reset is at a high level, the inputting signal of the second signal terminal Reset1 is at a high level, the inputting signal of the third signal terminal Scan1 is at a low level, the inputting signal of the fourth signal terminal Scan2 is at a high level, the inputting signal of the fifth signal terminal Scan3 is at a high level, the inputting signal of the sixth signal terminal EM1 is at a high level, and the inputting signal of the seventh signal terminal EM2 is at a high level. At this time, only the third transistor M3 is turned on and the other transistors are turned off. When a light is incident on a PN junction of the photosensitive device PD, the photon quantum excitation generates an electron-hole pair on the PN junction, so that the charge on a capacitor of the PN junction is recombined, thereby reducing the potential of the second node N2 to Vdata1 which is then stored at both ends of the first capacitor C1, so as to be ready for a compensating period.

At step 1003, during the third period t3, the inputting signal of the first signal terminal is at a high level, the inputting signal of the second signal terminal is at a high level, the inputting signal of the third signal terminal is at a high level, the inputting signal of the fourth signal terminal is at a low level, the inputting signal of the fifth signal terminal is at a high level, the inputting signal of the sixth signal terminal is at a high level, and the inputting signal of the seventh signal terminal is at a high level.

Figure 8:
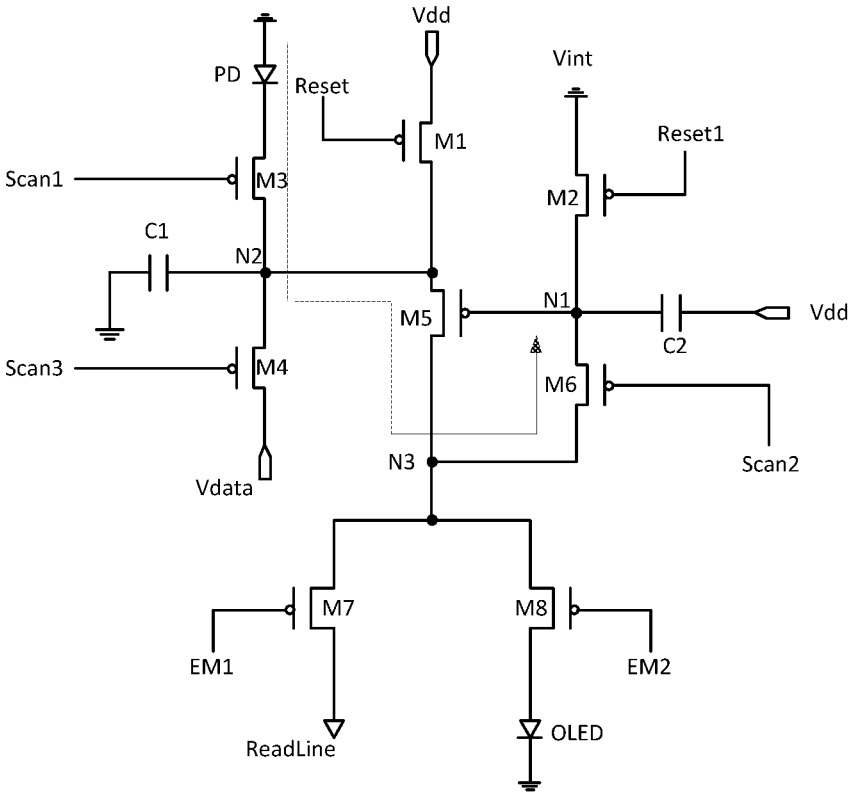
FIG. 8 shows a schematic diagram of the current flow of the pixel circuit during the third period according to the driving method of FIG. 4.

FIG. 8 shows a schematic diagram of the current flow of the pixel circuit during the third period t3 according to the embodiment of FIG. 4. As shown in FIG. 8, the direction of the arrow in the figure represents the current flow. During the third period t3, the inputting signal of the first signal terminal Reset is at a high level, the inputting signal of the second signal terminal Reset1 is at a high level, the inputting signal of the third signal terminal Scan1 is at a high level, the inputting signal of the fourth signal terminal Scan2 is at a low level, the inputting signal of the fifth signal terminal Scan3 is at a high level, the inputting signal of the sixth signal terminal EM1 is at a high level, and the inputting signal of the seventh signal terminal EM2 is at a high level. At this time, the sixth transistor M6 and the fifth transistor M5 are turned on, while the other transistors are turned off. Since the potential of the first node N1 is 0V previously, the fifth transistor M5 is turned on, and the signal of Vdata1 starts charging the first node N1 via the fifth transistor M5 and the sixth transistor M6, until the first node N1 is charged to Vdata1−Vth. At this time, the voltage difference between the gate and the source of the fifth transistor M5 is Vth. After the charging is completed, the potential of the first node N1 will always be maintained at Vdata1−Vth.

At step 1004, during the fourth period t4, the inputting signal of the first signal terminal is at a low level, the inputting signal of the second signal terminal is at a high level, the inputting signal of the third signal terminal is at a high level, the inputting signal of the fourth signal terminal is at a high level, the inputting signal of the fifth signal terminal is at a high level, the inputting signal of the sixth signal terminal is at a low level, and the inputting signal of the seventh signal terminal is at a high level.

Figure 9:
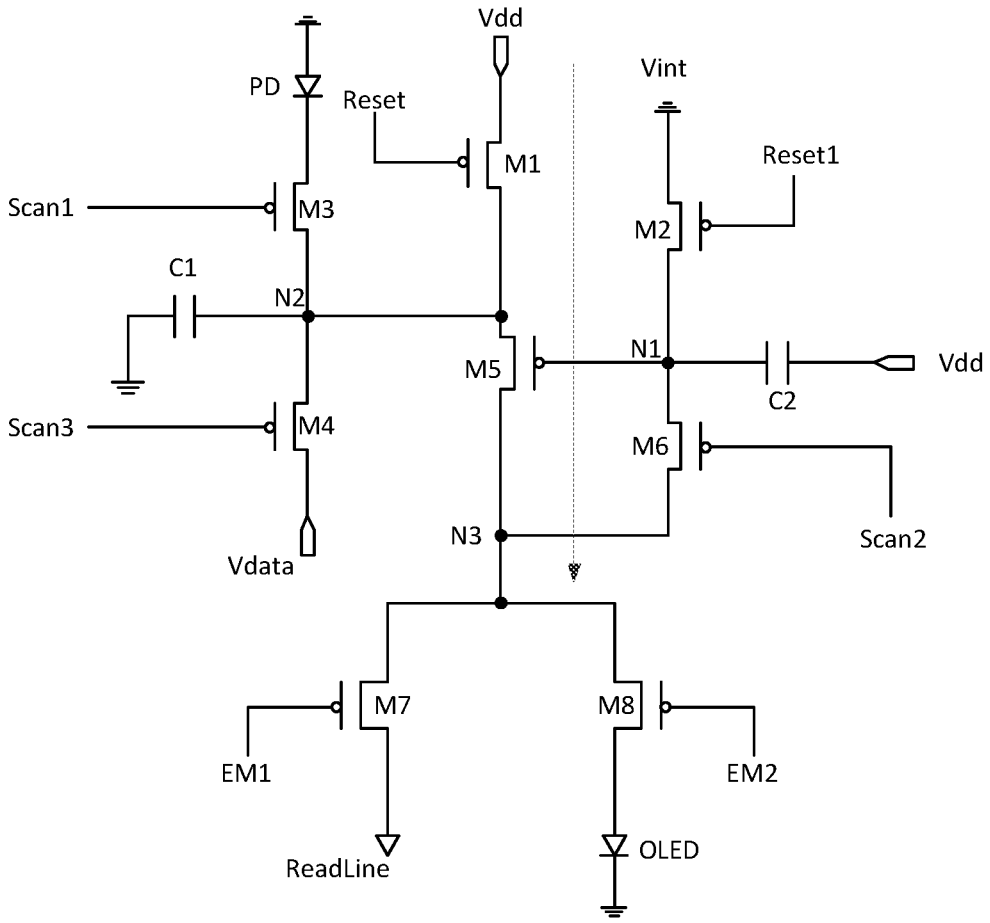
FIG. 9 shows a schematic diagram of the current flow of the pixel circuit during the fourth period according to the driving method of FIG. 4.

FIG. 9 shows a schematic diagram of the current flow of the pixel circuit during the fourth period t4 according to the embodiment of FIG. 4. As shown in FIG. 9, the direction of the arrow in the figure represents the current flow. During the fourth period t4, the inputting signal of the first signal terminal Reset is at low level, the inputting signal of the second signal terminal Reset1 is at high level, the inputting signal of the third signal terminal Scan1 is at a high level, the inputting signal of the fourth signal terminal Scan2 is at a high level, the inputting signal of the fifth signal terminal Scan3 is at a high level, the inputting signal of the sixth signal terminal EM1 is at a low level, and the inputting signal of the seventh signal terminal EM2 is at a high level. At this time, the first transistor M1 and the seventh transistor M7 are turned on, so that the source of the fifth transistor M5 is connected to the voltage terminal Vdd. The potential of the second node N2 is Vdd. The current flows through the first transistor M1 and the fifth transistor M5 to the seventh transistor M7, and then is output by the read terminal Readline. It can be derived by an equation for the transistor saturation current for the fifth transistor M5 as follows:

$$I=K(Vgs-Vth)^2=K[Vdd-(V\text{data1}-Vth)-Vth]^2=K(Vdd-V\text{data1})^2$$

wherein K is the current coefficient of M3, and $$K = C_{ox} \cdot \mu \cdot \frac{W}{L},$$

μ is the field effect mobility of M3, $C_{ox}$ is the capacitance per sub-circuit area for the gate insulating layer, W is the channel width and L is the channel length.

It can be seen from the above equation that the operation current I of the source follower transistor M5 is independent from its threshold voltage Vth of the source follower transistor M5 at this time, but only related with Vdd and Vdata1. Vdata1 is directly generated by the irradiation on the diode PN junction, avoiding a drift of the threshold voltage Vth of the source follower transistor, and ensuring an accuracy of the signal data.

At step 1005, during the fifth period t5, the inputting signal of the first signal terminal is at a high level, the inputting signal of the second signal terminal is at a low level, the inputting signal of the third signal terminal is at a high level, the inputting signal of the fourth signal terminal is at a high level, the inputting signal of the fifth signal terminal is at a high level, the inputting signal of the sixth signal terminal is at a high level, and the inputting signal of the seventh signal terminal is at a high level.

Figure 10:
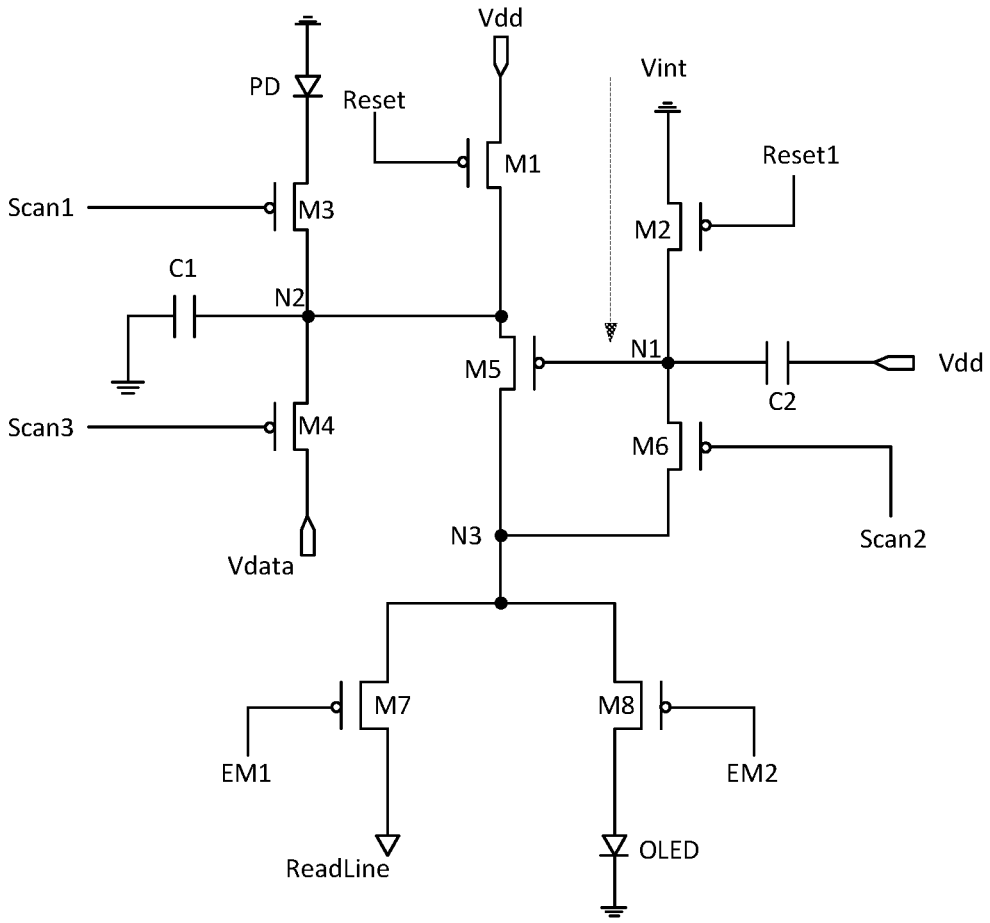
FIG. 10 shows a schematic diagram of the current flow of the pixel circuit during the fifth period according to the driving method of FIG. 4.

FIG. 10 shows a schematic diagram of the current flow of the pixel circuit during the fifth period t5 according to the embodiment of FIG. 4. As shown in FIG. 10, the direction of the arrow in the figure represents the current flow. During the fifth period t5, the inputting signal of the first signal terminal Reset is at a high level, the inputting signal of the second signal terminal Reset1 is at a low level, the inputting signal of the third signal terminal Scan1 is at a high level, the inputting signal of the fourth signal terminal Scan2 is at a high level, the inputting signal of the fifth signal terminal Scan3 is at a high level, the inputting signal of the sixth signal terminal EM1 is at a high level and the inputting signal of the seventh signal terminal EM2 is at a high level. At this time, the second transistor M2 is turned on, and the other transistors are turned off. In this case, the first node N1 is reset to the ground. Thus, the first node N1 has the potential of 0V. Certainly, the potential of the first node N1 could also be reset to a negative voltage.

At step 1006, during the second period t6, the inputting signal of the first signal terminal is at a high level, the inputting signal of the second signal terminal is at a high level, the inputting signal of the third signal terminal is at a high level, the inputting signal of the fourth signal terminal is at a low level, the inputting signal of the fifth signal terminal is at a low level, the inputting signal of the sixth signal terminal is at a high level, and the inputting signal of the seventh signal terminal is at a high level.

Figure 11:
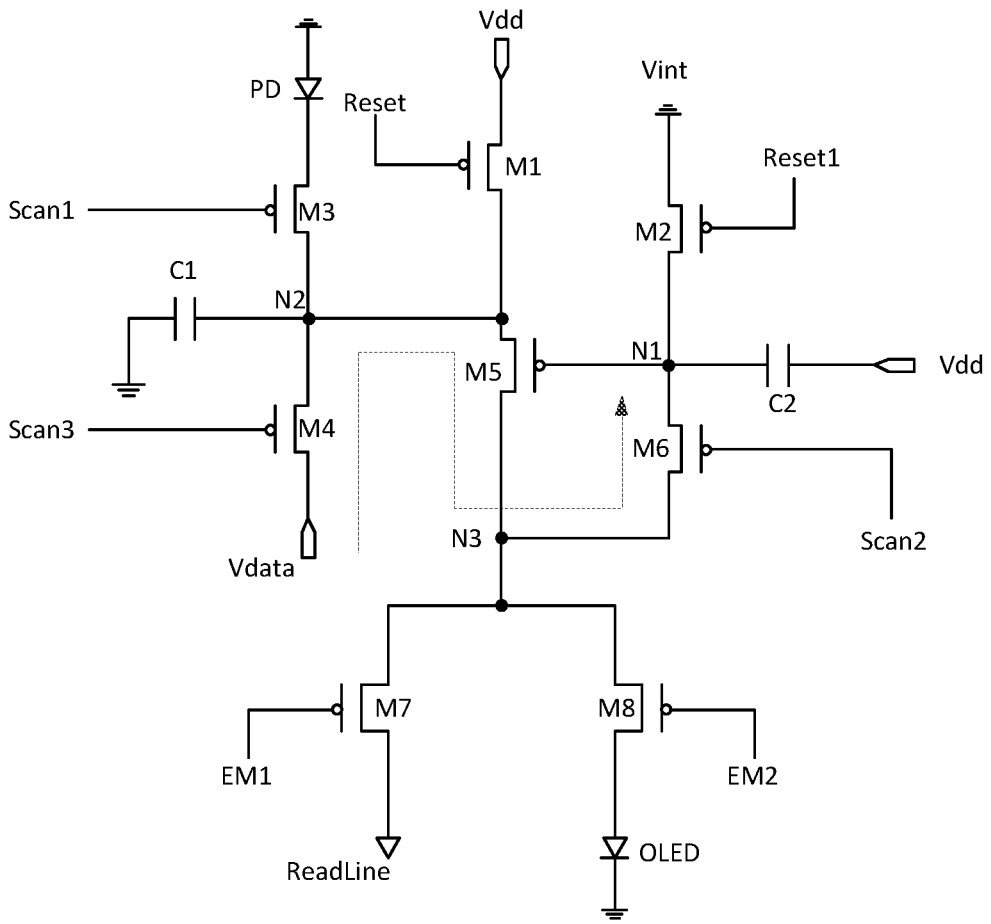
FIG. 11 shows a schematic diagram of the current flow of the pixel circuit during the sixth period according to the driving method of FIG. 4.

FIG. 11 shows a schematic diagram of the current flow of the pixel circuit during the sixth period t6 according to the embodiment of FIG. 4. As shown in FIG. 11, the direction of the arrow in the figure represents the current flow. During the sixth period t6, the inputting signal of the first signal terminal Reset is at a high level, the inputting signal of the second signal terminal Reset1 is at a high level, the inputting signal of the third signal terminal Scan1 is at a high level, the inputting signal of the fourth signal terminal Scan2 is at a low level, the inputting signal of the fifth signal terminal Scan3 is at a low level, the inputting signal of the sixth signal terminal EM1 is at a high level, and the inputting signal of the seventh signal terminal EM2 is at a high level. At this time, the sixth transistor M6, the fifth transistor M5 and the fourth transistor M4 are turned on. Since the potential of the first node N1 is 0V previously, the fifth transistor M5 will be charged again for compensating. The signal of Vdata1 may start charging the first node N1 via the fourth transistor M4, the fifth transistor M5 and the sixth transistor M6, until the first node N1 is charged to Vdata2−Vth. At this time, the voltage difference between the gate and the source of the fifth transistor M5 is Vth. After the charging is completed, the potential of the first node N1 will always be maintained at Vdata2−Vth.

At step 1007, during the seventh period t7, the inputting signal of the first signal terminal is at a low level, the inputting signal of the second signal terminal is at a high level, the inputting signal of the third signal terminal is at a high level, the inputting signal of the fourth signal terminal is at a high level, the inputting signal of the fifth signal terminal is at a high level, the inputting signal of the sixth signal terminal is at a high level, and the inputting signal of the seventh signal terminal is at a low level.

Figure 12:
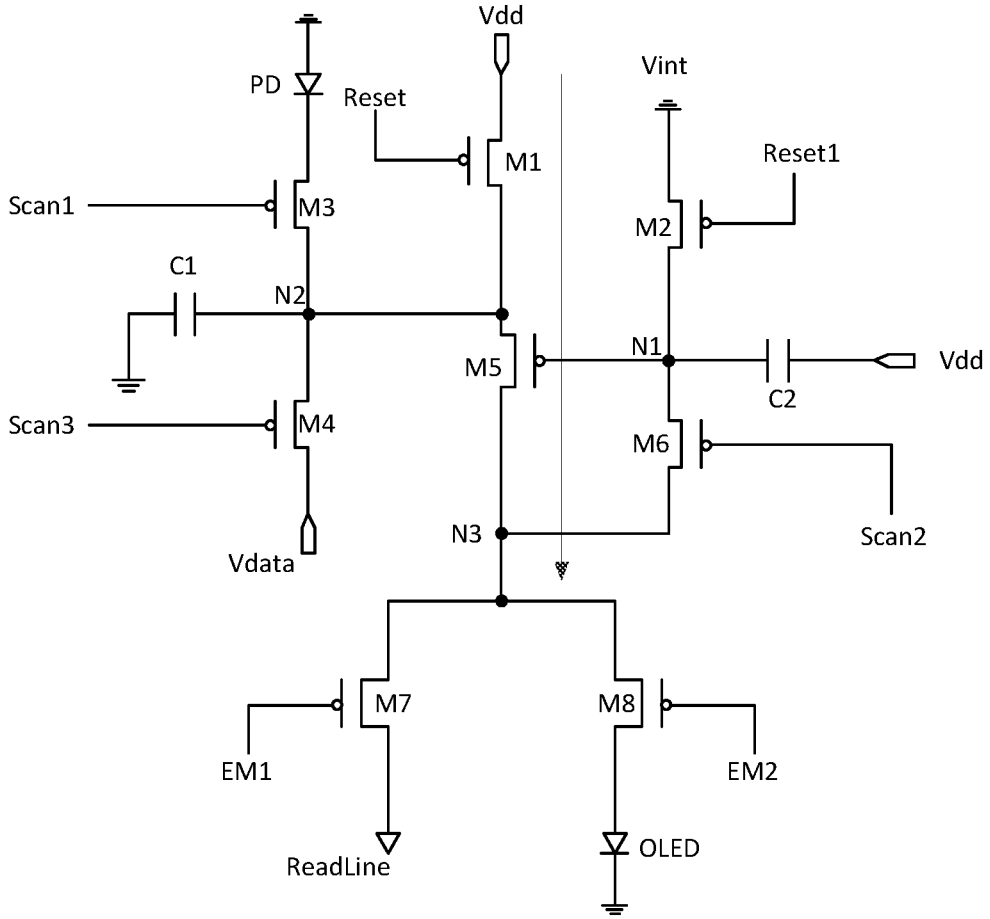
FIG. 12 shows a schematic diagram of the current flow of the pixel circuit during the seventh period according to the driving method of FIG. 4.

FIG. 12 shows a schematic diagram of the current flow of the pixel circuit during the seventh period t7 according to the embodiment of FIG. 4. As shown in FIG. 12, the direction of the arrow in the figure represents the current flow. During the seventh period t7, the inputting signal of the first signal terminal Reset is at a low level, the inputting signal of the second signal terminal Reset1 is at a high level, the inputting signal of the third signal terminal Scan1 is at a high level, the inputting signal of the fourth signal terminal Scan2 is at a high level, the inputting signal of the fifth signal terminal Scan3 is at a high level, the inputting signal of the sixth signal terminal EM1 is at a high level, and the inputting signal of the seventh signal terminal EM2 is at a low level.

At this time, the first transistor M1 is turned on, so that the source of the fifth transistor M5 is connected to the voltage terminal Vdd. The potential of the second node N2 is Vdd. The current flows through the first transistor M1 and the fifth transistor M5 to the eighth transistor M8, so that the light emitting device OLED emits light. It can be derived by an equation for the transistor saturation current for the fifth transistor M5 as follows:

$$I_{OLED}=K(Vgs-Vth)^2=K[Vdd-(V\text{data2}-Vth)-Vth]^2=K(Vdd-V\text{data2})^2$$

It can be seen from the above equation that the current $I_{oled}$ is independent from the threshold voltage Vth at this time, but only related to the voltage value which is used to charge the fifth transistor M5 by the second voltage terminal Vdata during the second charging period, Vdata2. Thus, the drift of the threshold voltage Vth of source follower transistor M3 which is caused by processes and operations can be avoided, thereby ensuring an normal operation of the light emitting device OLED.

It can be understood that the above embodiments are merely exemplary embodiments used for illustrating the principle of the embodiments of the present disclosure, but the embodiments of the present disclosure are not limited thereto. For those skilled in the art, various variations and improvements may be made without departing from the spirit and essence of the embodiments of the present disclosure, and these variations and improvements are also considered as the scope of the embodiments of the present disclosure.

We claim:

1. A pixel circuit, comprising:

a resetting sub-circuit, connected to a first signal terminal, a first voltage terminal, a second signal terminal, a first node and a second node, and configured to control potentials of the first node and the second node according to inputting signals of the first signal terminal and the second signal terminal;

a charging sub-circuit, connected to a third signal terminal and the second node, and configured to control a potential of the second node according to an inputting signal of the third signal terminal;

a compensating sub-circuit, connected to the second node, the first node, the first voltage terminal, a fourth signal terminal, a third node, the second voltage terminal and a fifth signal terminal, and configured to control the potentials of the first node and the third node according to inputting signals of the fourth signal terminal and the fifth signal terminal and the potential of the second node; and an outputting sub-circuit, connected to a first terminal of a light emitting device which has its second terminal connected to a ground, wherein the outputting sub-circuit is connected to the third node, a sixth signal terminal, a reading terminal and a seventh signal terminal, and configured to control a signal outputted to the first terminal of the light emitting device and the reading terminal according to the inputting signal of the sixth signal terminal and the seventh signal terminal and the potential of the third node.

2. The pixel circuit of claim 1, wherein the outputting sub-circuit comprises:

a reading circuit, connected to the third node, the reading terminal and the sixth signal terminal, and configured to control the outputting signal of the reading terminal according to the inputting signal of the sixth signal terminal and the potential of the third node;

a light emitting circuit, connected to the third node, the seventh signal terminal and a first terminal of the light emitting device, and configured to control a signal outputted to the first terminal of the light emitting device according to the inputting signal of the seventh signal terminal and the potential of the third node.

3. The pixel circuit of claim 1, wherein the resetting sub-circuit comprises a first transistor and a second transistor;

the first transistor has a gate connected to the first signal terminal, a first electrode connected to the first voltage terminal and a second electrode connected to the second node; and the second transistor has a gate connected to the second signal terminal, a first electrode connected to the ground and a second electrode connected to the first node.

4. The pixel circuit of claim 1, wherein the charging sub-circuit comprises a third transistor and a first capacitor, wherein:

the third transistor has a first electrode connected to a second electrode of a photosensitive device whose first electrode is connected to a ground, a gate connected to the third signal terminal, and a second electrode connected to the second node; and the first capacitor has a first terminal connected to the ground and a second terminal connected to the second node.

5. The pixel circuit of claim 1, wherein the compensating sub-circuit comprises a fourth transistor, a fifth transistor, a sixth transistor and a second capacitor, wherein:

the fourth transistor has a gate connected to the fifth signal terminal, a first electrode connected to the second node and a second electrode connected to the second voltage terminal;

the fifth transistor has a gate connected to the first node, a first electrode connected to the second node and a second electrode connected to the third node;

the sixth transistor has a gate connected to the fourth signal terminal, a first electrode connected to the first node and a second electrode connected to the third node; and the second capacitor has a first terminal connected to the first node and a second terminal connected to the first voltage terminal.

6. The pixel circuit of claim 2, wherein the reading circuit comprises a seventh transistor, wherein the seventh transistor has a gate connected to the sixth signal terminal, a first electrode connected to the third node and a second electrode connected to the reading terminal.

7. The pixel circuit of claim 2, wherein the reading circuit comprises an eighth transistor, wherein the eighth transistor has a gate connected to the seventh signal terminal, a first electrode connected to the third node and a second electrode connected to the first terminal of the light emitting device.

8. The pixel circuit of claim 2, wherein each of the first transistor to the eighth transistor is an N-type transistor or a P-type transistor.

9. The pixel circuit of claim 1, wherein the photosensitive device comprises a photodiode.

10. A display apparatus comprising the pixel circuit according to claim 1.

11. A method of driving a pixel circuit, comprising the pixel circuit according to claim 1, wherein the first voltage terminal is applied to a voltage at a first level, and the second voltage terminal is applied to a data signal voltage;

the method of driving the pixel circuit comprising:

applying, a second level to the first signal terminal which is different from the first level, the second level to the second signal terminal, the second level to the third signal terminal, the first level to the fourth signal terminal, the first level to the fifth signal terminal, the first level to the sixth signal terminal and the first level to the seventh signal terminal, during a first period;

applying, the first level to the first signal terminal, the first level to the second signal terminal, the second level to the third signal terminal, the first level to the fourth signal terminal, the first level to the fifth signal terminal, the first level to the sixth signal terminal and the first level to the seventh signal terminal, during a second period;

applying, the first level to the first signal terminal, the first level to the second signal terminal, the first level to the third signal terminal, the second level to the fourth signal terminal, the first level to the fifth signal terminal, the first level to the sixth signal terminal and the first level to the seventh signal terminal, during a third period; and applying, the second level to the first signal terminal, the first level to the second signal terminal, the first level to the third signal terminal, the first level to the fourth signal terminal, the first level to the fifth signal terminal, the second level to the sixth signal terminal and the first level to the seventh signal terminal, during a fourth period.

12. The method of claim 11, further comprising:

applying, the first level to the first signal terminal, the second level to the second signal terminal, the first level to the third signal terminal, the first level to the fourth signal terminal, the first level to the fifth signal terminal, the first level to the sixth signal terminal and the first level to the seventh signal terminal, during a fifth period;

applying, the first level to the first signal terminal, the first level to the second signal terminal, the first level to the third signal terminal, the second level to the fourth signal terminal, the second level to the fifth signal terminal, the first level to the sixth signal terminal and the first level to the seventh signal terminal, during a sixth period; and applying, the second level to the first signal terminal, the first level to the second signal terminal, the first level to the third signal terminal, the first level to the fourth signal terminal, the first level to the fifth signal terminal, a high level to the sixth signal terminal and the second level to the seventh signal terminal, during a seventh period.

13. The pixel circuit of claim 2, wherein each of the first transistor to the eighth transistor is a P-type transistor.

* * * * *